United States Patent [19]

Bolduc

[11] Patent Number: 4,876,970

[45] Date of Patent: Oct. 31, 1989

[54] COIN OPERATED INFANT CHANGING TABLE

[76] Inventor: Wendy Bolduc, 5285 Elmhurst St., Ventura, Calif. 93003

[21] Appl. No.: 225,829

[22] Filed: Jul. 29, 1988

[51] Int. Cl.[4] ..... A47B 3/00

[52] U.S. Cl. ..... 108/35; 312/248; 70/DIG. 1; 221/199

[58] Field of Search ..... 108/35, 33, 42, 48, 108/38; 70/DIG. 1; 312/248; 221/199

[56] References Cited

U.S. PATENT DOCUMENTS

| | | | |
|---|---|---|---|
| 363,372 | 5/1887 | Dollens | 312/248 X |
| 1,077,846 | 11/1913 | Mayer | 70/DIG. 1 |
| 1,128,477 | 2/1915 | McKee | 312/248 X |
| 1,517,044 | 11/1924 | Boyer | 312/227 |
| 2,275,373 | 3/1942 | Barrett | 312/248 X |
| 2,735,737 | 2/1956 | Hancock | 108/350 X |
| 2,817,571 | 12/1957 | Lee | 312/313 |
| 2,851,700 | 9/1958 | Denison | 5/93 |
| 2,857,222 | 10/1958 | Keck | 108/50 |
| 3,232,663 | 2/1966 | Janke | 297/147 |
| 3,689,344 | 8/1972 | Gilinger | 312/248 X |
| 4,613,996 | 9/1986 | Chase | 5/2 R |

*Primary Examiner*—Peter A. Aschenbrenner
*Attorney, Agent, or Firm*—Francis X. LoJacono

[57] ABSTRACT

A coin operated infant changing table includes a generally rectangular housing supporting a movable cover unit secured to the housing in a pivotal fashion. A coin receiving unit controls an internal lock which releasably secures the pivotable cover unit to the housing in a closed position. Automatic product dispensing means are provided which dispense a convenience product during the opening motion of the cover unit and hinged support arms secure the extended position of the cover unit while providing safety members to partially enclose the infant placed upon the cover unit. A disposable paper roll provides a supply of fresh paper to the infant changing surface.

10 Claims, 2 Drawing Sheets

134
155
152
113
125
124
15
135
133
145
123
122
148
149
132
112
27
114
115
21
154
153
12
110
111

144
143
18
68
131
142
136
134
135
141
130
133
145
132
150
137
140
64

153
126
18
121
152
151
68
125
124
145
120
150
123
122
127
65

86
84
80
11
82
101
44
85
25
15
102
83
63
92
68
58
45
91
142
60
131
90
52
141
100
130
64
94
95
54
140
33
73
137
50
24
113
72
127
53
112
56
26
20
55
111
17
51
70
110
77
74
76
27
21
72
79
78
57
66
12
14
67
75

20
12
13
14
11
10
25
15
41
40
42
24
46
33
30
34
31
32
35
23
22
62
61
68
63
80
25
58
15
45
59
53
44
52
64
65
54
73
50
24
72
56
55
23
17
51
26
20
22
70
74
21
71
66
57
16
14
27
12
67
75

COIN OPERATED INFANT CHANGING TABLE

FIELD OF THE INVENTION

This invention relates generally to folding tables and work surfaces and particularly to folding tables used for infant care and diapering.

BACKGROUND OF THE INVENTION

Persons caring for infant children must periodically attend to their needs of cleaning and diapering as well as changes of clothes. While this task is comparatively simple to carry forward in the home environment, there arises considerable difficulty in meeting these infant care needs during periods of travel or other periods spent in public environments. One of the major difficulties presented during such travel periods and time spent in public environments is the general lack of access to appropriate sanitary care facilities to accomplish the infant care needs. More particularly, there arises a need for a conveniently available sanitary surface upon which the infant may be placed during infant care and diapering. In addition, there arises a need for access to certain products which are generally used in the care and cleansing of an infant during diapering and other infant care activities.

In general, this need has been virtually ignored by persons maintaining travel facilities and public environments. As a result, there has arisen a need to provide appropriate infant care facilities to travelers and persons occupying public environments. This need has prompted practitioners in the art to create various devices intended to make such infant care facilities available.

U.S. Pat. No. 2,851,700 issued to Denison sets forth a COMBINED CHILD' CRIB AND DRESSING TABLE in which a conventional child's crib is adapted to support a pivotally mounted dressing table surface. The dressing table is supported alternatively in a storage position or an extended position in which it overlies a portion of the child's crib and is supported thereby.

U.S. Pat. No. 2,735,737 issued to Hancock sets forth a DIAPERING SUPPORT in which a wall mounted housing supports a roll of disposable paper against a wall surface such that the desired quantity of disposable paper may be drawn outwardly from the housing. The housing further supports a flat surface which is hingeably secured to the housing at one end and supported by a pair of folding arms near the other end. The flat surface is foldable to a closed position against the supporting wall and an open position in a general horizontal orientation extending outwardly from the housing and supported by the folding arms. The disposable paper is drawn outwardly from the housing to overlie the flat surface during infant diapering and care.

U.S. Pat. No. 4,613,996 issued to Chase, et al. sets forth a FOLDING CHILD SUPPORT in which a generally rectangular enclosure is adapted to be securely supported by a wall surface. The enclosure includes a hingeably secured outer surface which is pivotable between a closed position securing the enclosure and an extended position in which it forms a generally horizontal child care surface. The enclosure further supports a plurality of compartments and shelves and a variety of integrally molded utility features.

U.S. Pat. No. 2,817,571 issued to Lee sets forth a WALL ATTACHED FOLDING TABLE in which a generally planar table is secured to a wall mounted support structure by a plurality of articulated arms and springs. Means are provided for locking the table in the extended position during use and for folding the table against the supporting wall during periods of nonuse.

In addition to the foregoing, practitioners in the art have provided other examples of folding table or work support mechanisms. U.S. Pat. No. 3,232,663 issued to Janke, U.S. Pat. No. 2,857,222 issued to Keck, and U.S. Pat. No. 1,517,044 issued to Boyer all set forth examples of different folding and support structures for collapsible and foldable table devices.

While the foregoing described devices provide some attention to the needs of persons traveling with infants or moving in public environments with infants, they have thus far failed to properly provide for the complete needs of the persons caring for infants during travel and public activity. As a result, there remains a need in the art for a convenient, easily accessible and reliably sanitary facility for use by persons during infant care.

SUMMARY OF THE INVENTION

Accordingly, it is a general object of the present invention to provide an improved facility for use in infant care by persons traveling or in public environments. It is a more particular object of the present invention to provide an improved facility for infant care which simultaneously meets the needs for a sanitary work surface and the accessibility of convenience products associated with infant diapering and other infant care.

In accordance with the present invention, there is provided an enclosure adapted to be received upon and secured to a vertical wall surface which includes an enclosure cover foldable between a closed position and an outwardly extending horizontal position together with means for dispensing infant care items each time the enclosure cover is moved to the open or extending position. The present invention further includes a disposable covering for the extending enclosure cover and a coin operated latch mechanism which controls the movement of the enclosure cover and the dispensing of infant care products.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figures 1, 2:
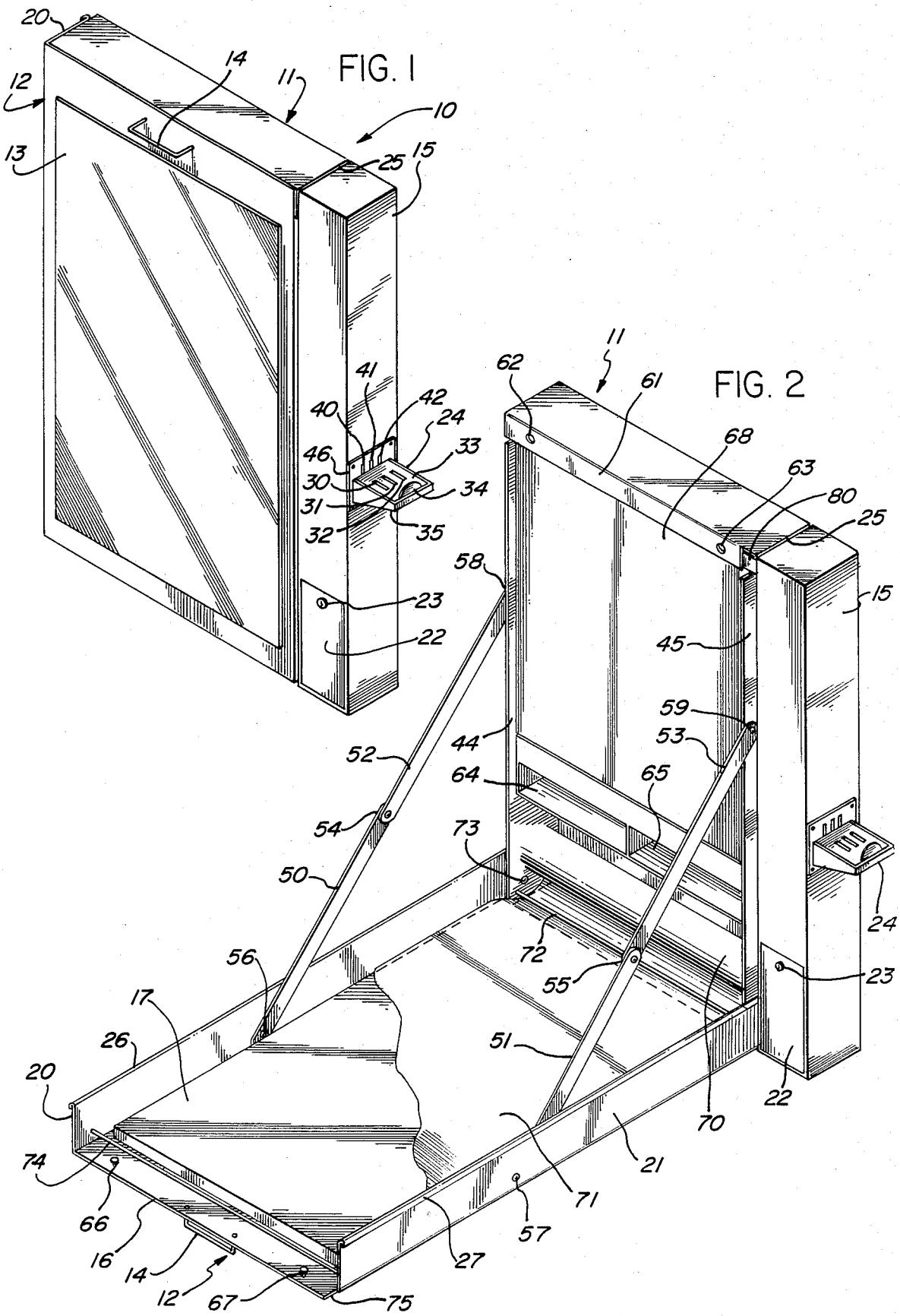
FIG. 1 is a perspective view of the present invention coin operated infant changing table in the closed position.
FIG. 2 is a perspective view of the present invention coin operated infant changing table in the open position.

FIG. 1 sets forth a perspective view of the present invention coin operated infant changing table generally referenced by numeral 10 in its closed position. Changing table 10 includes a generally rectangular wall housing 11 which includes means (not shown) for securing wall housing 11 and thereby changing table 10 to a convenient vertical surface such as a wall or partition. While a variety of attachment means may be contemplated for securing wall housing 11 to a vertical surface, it has been found economical and advantageous to secure wall housing 11 by a plurality of conventional threaded fasteners in accordance with conventional fabrication techniques. A cover unit 12 defines a pair of generally parallel side members 20 and 21 and a front member 16. Sides 20 and 21 together with front 16 of cover unit 12 form a generally U-shaped member which by means set forth below in greater detail is pivotally secured to wall housing 11 such that sides 20 and 21 are received on either side of wall housing 11 in the closed position shown in FIG. 1. Front 16 further supports a mirror 13 secured thereto by conventional fabrication techniques such as adhesives or the like and a handle 14 extending outwardly from front 16 and positioned above mirror 13.

A coin operator housing 15 comprises a generally rectangular elongated housing secured to wall housing 11. Coin operator housing 15 in turn supports a coin receiver 24 constructed in accordance with conventional fabrication techniques. Coin receiver 24 defines a receiver plate 46 defining a plurality of receiver slots 40, 41 and 42. Receiver plate 46 is secured to coin operator housing 15. Coin receiver 24 further defines an outwardly extending slide support 35. A coin slide 33 defines a plurality of coin slots 30, 31 and 32 which are aligned respectively with receiver slots, 40, 41 and 42. Slide 33 further defines a handle 34. In accordance with conventional coin receiver mechanisms, slide 33 is slideably movable with respect to receiver plate 46 such that coin slots 30 through 32 are passed through receiver slots 40 through 42 respectively. Thus, a plurality of coins (not shown) may be received within coin slots 30 through 32 and passed through receiver slots 40 through 42 to operate coin receiver 24.

Coin operator housing 15 further defines a coin box 22 removably secured to the lower portion of housing 15 by a lock fastener 23. In the position shown in FIG. 1, cover unit 12 is secured to wall housing 11 to form the closed position in which the interior of changing table 10 is secured and in which access to the interior of changing table 10 is denied. Accordingly, by means set forth below in greater detail, cover unit 12 is securely locked to wall housing 11 such that pulling on handle 14 fails to pivot cover unit 12 away from wall housing 11.

In accordance with its intended use, changing table 10 remains in the closed position shown in FIG. 1 until the appropriate combination of coins are deposited within coin slots 30 through 32 and passed into coin receiver 24 by pushing slide 33 inwardly such that the deposited coins are passed through receiver slots 40 through 42 and deposited within coin box 22. By means set forth below in greater detail, the inward motion of slide 33 releases the lock mechanisms securing cover unit 12 to wall housing 11 permitting cover unit 12 to be pivoted downwardly to the open position shown in FIG. 2.

FIG. 2 sets forth a perspective view of changing table 10 in the open or extended position. Wall housing 11 remains in the vertical position suitable for attachment to a vertical surface as described above. Wall housing 11 further defines a downwardly extending lock plate 61 which in turn defines a pair of spaced apertures 62 and 63. Wall housing 11 further defines a pair of outwardly extending side members 44 and 45. Coin operator housing 15 is secured to side 45 of housing 11 such that a space 25 is maintained therebetween. As described above, coin operator housing 15 supports coin receiver 24 and coin box 22. Wall housing 11 further defines a product dispenser 60, the details of which are set forth below in greater detail, which includes a dispenser cover 68 and a pair of dispensing slots 64 and 65. As is described below in greater detail, dispenser cover 68 overlies a cavity within wall housing 11 which receives dispensable product and which in accordance with means set forth below in greater detail is dispensed through slots 64 and 65.

Cover unit 12, which as described above, comprises a generally planar front portion 16 and a pair of side members 20 and 21. Front 16 and sides 20 and 21 are joined to form a generally U-shaped member. In addition, sides 20 and 21 terminate on their upper surfaces in a pair of rolled edges 26 and 27. Side 21 further defines a notch 75. A comfort pad 17 formed of a resilient material such as foam rubber or plastic is received upon and secured to the interior surface of front 16. A tear bar 74 extends between sides 20 and 21 and is secured thereto in a spaced parallel relationship to front 16. Front 16 further supports a pair of lock pins 66 and 67. A pivot 73 provides a pivotal attachment between sides 44 and 20 while a similar pivotal attachment (not shown) secures sides 45 and 21. The pivotal attachment of sides 20 and 21 to sides 44 and 45 respectively permits cover unit 12 to be pivotally moved between the open position shown in FIG. 2 and the closed position shown in FIG. 1. A pair of support arms 50 and 52 are mutually secured at a center hinge 54. Support arm 50 is secured to side 20 by a hinge 56 while support arm 52 is secured to side 44 by a hinge 58 (not shown). A second pair of support arms 51 and 53 are mutually secured at a center hinge 55. Support arm 51 is secured to side 21 by a hinge 57 while support arm 53 is secured to side 45 by a hinge 59. In combination, support arms 50, 52, 53 and 55 cooperate to form folding arm structures which limit the pivotal motion of cover unit 12 between the open position shown in FIG. 2 and the closed position shown in FIG. 1. In addition, the placement of arms 50 through 53 is selected to provide a pair of safety supports on either side of comfort pad 17 which in the manner described below in greater detail tend to prevent an infant from rolling off of comfort pad 17 during infant care.

A paper roll 70, forming a supply of sanitary flexible paper or the like, is secured to sides 44 and 45 of wall housing 11 by means not shown but which should be understood to include conventional paper roller attachment means whereby a portion of paper 71 may be drawn from paper roll 70. A guide bar 72 is secured to sides 44 and 45 and positioned above front 16. Paper 71 is threaded beneath guide bar 72 and drawn outwardly across comfort pad 17 and beneath tear bar 74. With the present invention changing table in the open position shown in FIG. 2, the user obtains the fresh covering for comfort pad 17 by drawing a portion of paper 71 from paper roll 70 and tearing the surplus therefrom by use of tear bar 74.

In the open or extended position shown in FIG. 2, changing table 10 provides a secure infant care surface which is supported by support arms 50 through 53 and which is rendered sanitary and fresh by the use of paper covering 71. Thus, in its intended use, the infant is placed upon paper 71 above comfort pad 17 and rested therein between arms 50 and 51. The infant care servicing may then be carried forward with relative ease and relative comfort by the user. Once the infant care activities are completed, the infant is removed from comfort pad 17 and cover unit 12 is pivotally moved by handle 14 about its pivotal attachment to wall housing 11 until it closes to the position shown in FIG. 1. It should be noted that pins 66 and 67 are spaced in accordance with the spacing between apertures 62 and 63 and by means set forth below in greater detail are received therein during the closure of cover unit 12 to form the locking attachment referred to above.

Figure 3:
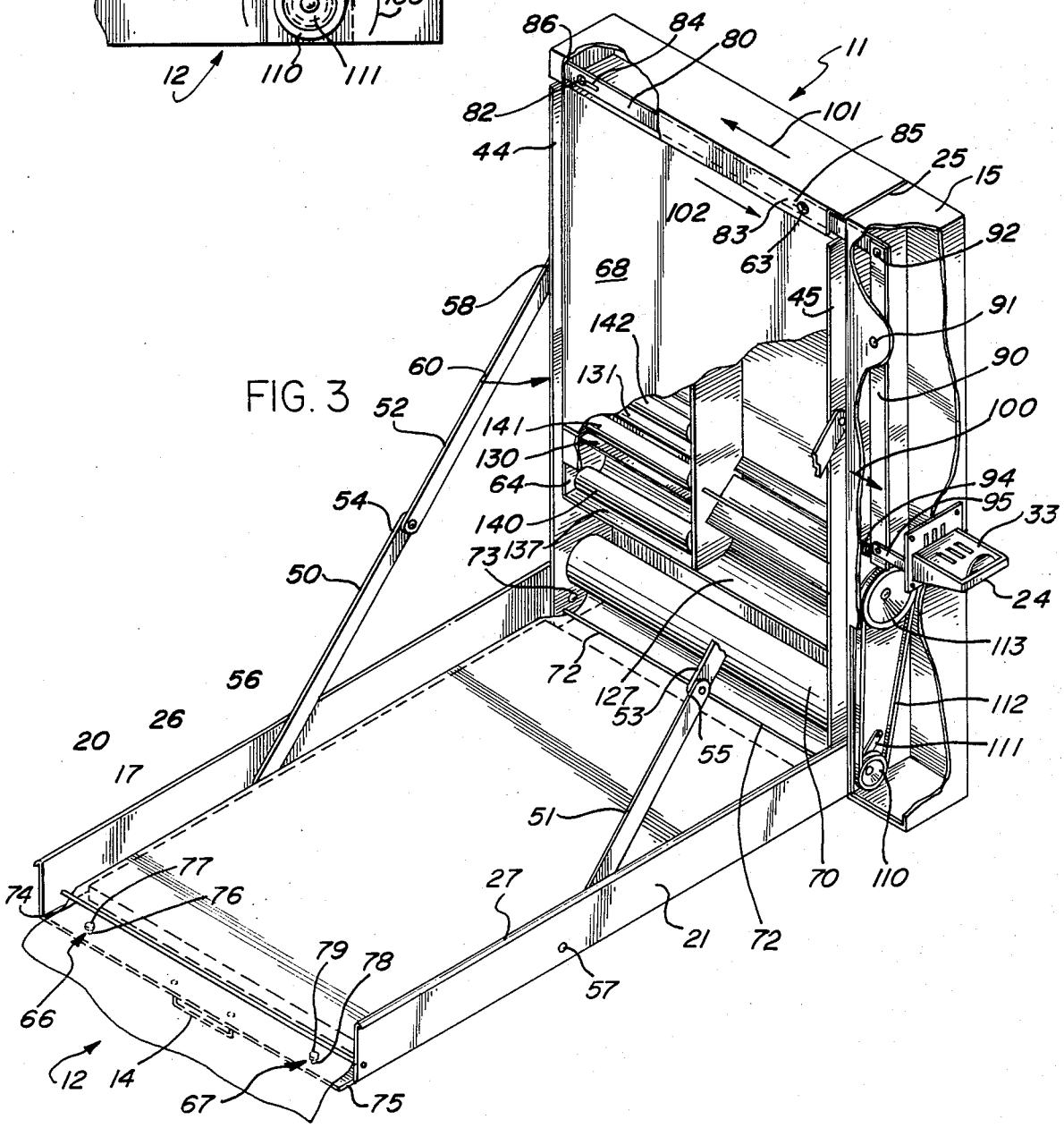
FIG. 3 is a partially sectioned view of the present invention coin operated infant changing table.

FIG. 3 sets forth a perspective partially sectioned view of the present invention coin operated infant changing table in the open position. As set forth above in connection with FIG. 2, wall housing 11 is supported in an upright or vertical position against a convenient wall surface by conventional attachment means (not shown). Housing 11 further defines a pair of downwardly extending side portions 44 and 45 and supports a convenience product dispenser 60. A divider 119 extends downwardly within housing 11 and provides a separation between sides 44 and 45. A dispenser cover 68 extends across divider 119 between sides 44 and 45 and provides a covering for the interior of housing 11. Dispenser cover 68 further defines a pair of bottom slots 64 and 65 (better seen in FIG. 2). A pair of paddle wheels 120 and 130 are supported within housing 11 near slots 64 and 65 by an elongated axle 145. As is further described below, paddle wheels 120 and 130 are secured to axle 145 and are rotatable within housing 11. Housing 11 further supports a pair of angled guide surfaces 121 and 131 together with a pair of curved guides 127 and 137. A plurality of convenience products represented by absorbent pads 140, 141 and 142 are supported within housing 11. As in further described above, pads 141 and 142 are captivated within housing 11 by paddle wheel 30 while pad 140 has been moved to its dispensing position in which the user may withdraw pad 140 from housing 11 through slot 64. While the portion of housing 11 between divider 119 and side 45 is shown empty in FIG. 3, it should be understood that, in normal use, it to would support a plurality of convenience products such as pads 140 through 142.

Housing 15 extends vertically in parallel relationship with housing 11 and is spaced therefrom to define a space 25 extending between housing 11 and housing 15. As described above, housing 15 supports a coin receiver 24 constructed in accordance with conventional fabrication techniques. Coin receiver 24 further includes an inwardly extending arm 95 which is operative in response to motion of slide 33. A lock bar 90 is pivotally secured to housing 15 by a pivot pin 91. In addition, lock bar 90 is pivotally attached to arm 95 by a pivot pin 93 at one end. A lock bar 80 defines a pair of apertures 82 and 83 together with a pair of slot portions 84 and 85 extending therefrom. Lock bar so is pivotally secured to the remaining end of lock bar 90 by a pivot pin 92 and is supported within housing 11 by an end receptacle 86. A spring 94 is coupled between housing 15 and lock bar 90 to urge lock bar 90 to pivot about pivot 91 in the counterclockwise direction indicated by arrow 100 which in turn urges lock bar 80 to the left as indicated by arrow 101 causing slots 84 and 85 to be aligned with apertures 62 and 63 in housing 11. The alignment of slots 84 and 85 with apertures 62 and 63 forms the locked position of the present invention coin operated infant changing table.

Axle 145 further supports a pulley 113 in a fixed attachment whereby rotation of pulley 113 causes a corresponding rotation of axle 145 and paddle wheels 120 and 130. Housing 11 further supports a ratchet drive unit 111 constructed in accordance with conventional ratchet mechanisms and supporting a pulley 110. As in set forth below in greater detail, ratchet unit 111 couples pulley 110 to side 21 of cover unit 12 in a ratcheting or one-way drive configuration. A flexible belt 112 couples pulley 110 to pulley 113.

A cover unit 12, constructed in the manner described above, defines a generally U-shaped member pivotally secured to housing 11 by a pair of pivots 73 and 74 (pivot 74 not shown). Cover unit 12 defines a pair of side portions 20 and 21 and a generally planar front portion 16. Front portion 16 in turn supports a resilient pad 17, a handle 14, and a pair of upwardly extending lock pins 66 and 67. Pins 66 and 67 are spaced in accordance with the spacing of apertures 62 and 63 of wall housing 11. Pin 66 comprises an upwardly extending stem 76 and an expanded head 77. Similarly, pin 67 defines an upwardly extending stem 78 and an expanded head 79. A pair of support arms 50 and 52 are secured at a center hinge 54. Arm 52 is secured to side 44 of housing 11 at a hinge 58 while arm 50 is secured to side 20 of cover unit 12 by a hinge 56. Similarly, a pair of support arms 51 and 53 are pivotally secured at a center hinge 55. Arm 53 is pivotally secured to side 45 of housing 11 by a hinge 59 while arm 51 is pivotally secured to side 21 of cover unit 12 by a hinge 57. Cover unit 12 further supports a laterally extending guide bar 72 and a paper roll 70 together with a laterally extending tear bar 74. Paper 71 is drawn outwardly from roll 70 beneath guide bar 72 and across pad 17 and beneath tear bar 74. Thereafter, the excess portion of paper 71 may be removed by drawing it upwardly against tear bar 74. The important aspect is that a fresh covering paper 71 may thus be provided for resilient pad 17 to assure the presence of a clean dry surface for the infant.

In operation, a plurality of coins are placed within slide 33 which permit slide 33 of coin receiver 12 to be moved inwardly which in turn drives arm 95 inwardly overcoming spring 94. The inward motion of arm 95 causes lock bar 90 to pivot about pivot 91 in a clockwise manner which in turn draws lock bar 80 in the direction indicated by arrow 102. As lock bar 80 is drawn in the direction of arrow 102, apertures 82 and 83 in lock bar 80 are aligned with apertures 62 and 63 respectively of housing 11. The alignment of apertures 82 and 83 with apertures 62 and 63 releases pins 66 and 67 respectively of cover unit 12. Thus, with the present invention coin operated infant changing table in the closed position of FIG. 1, the foregoing described operation of coin receiver 24 releases pins 66 and 67 and permits cover unit 12 to be pivoted to the open position shown in FIGS. 2 and 3. During the pivotal motion of cover unit 12, ratchet drive unit 111 causes a corresponding angular rotation of pulley 110. The rotation of pulley 110 is coupled to pulley 113 by belt 112 causing a corresponding rotation of paddles 120 and 130. In accordance with the arrangement set forth above in greater detail, the relative sizes of pulleys 110 and 113 as well as the angular relationship between paddle wheels 120 and 130 is selected to provide the release of a single one of the convenience products stored within dispenser 60 during a single opening motion of cover unit 12. Thus, in opening the present invention coin operated infant changing table from the closed position of FIG. 1 to the extended position shown in FIGS. 2 and 3, a single convenience product is dispensed to the user.

Once slide 33 of coin receiver 24 is released, spring 94 urges arm 95 outwardly in the direction of arrow 100 which in turn pivots lock bar 90 in the counterclockwise direction causing lock bar 80 to be moved in the direction indicated by arrow 101 such that slots 84 and 85 are once again aligned with apertures 62 and 63 respectively of the wall housing 11. As a result, the return of cover unit 12 to the closed position shown in FIG. 1 causes pins 66 and 67 to be forced through apertures 62 and 63 respectively and causes lock bar 80 to be urged in the direction of arrow 102 forcing lock bar 80 to temporarily assume the position in which apertures 82 and 83 are aligned with apertures 62 and 63 respectively and permitting heads 77 and 79 of pins 66 and 67 to be received within apertures 82 and 83. Once heads 77 and 79 pass through apertures 82 and 83 respectively, the urging force of spring 94 causes lock bar 80 to be moved in the direction indicated by arrow 101 causing stem portions 76 and 78 of pins 66 and 67 to be captivated within slots 84 and 85 of lock bar 80. The captivation of pins 66 and 67 within slots 84 and 85 respectively secures cover unit 12 in the closed position shown in FIG. 1.

It should be noted that, in accordance with conventional ratchet drive fabrication techniques, the pivoting motion of cover unit 12 in returning from the open position shown in FIG. 3 to the closed position shown in FIG. 1 is not coupled to pulley 110. As a result, no dispensing of product occurs during the closing operation of the present invention coin operated infant changing table.

Figure 4:
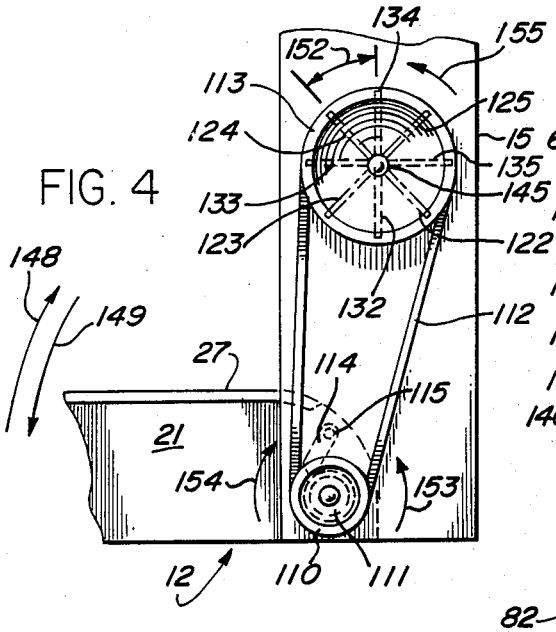
FIG. 4 is a partial section view of a portion of the present invention coin operated infant changing table.

FIG. 4 sets forth a partial view of the present invention coin operated infant changing table in which housing 15 is supported against a convenient vertical surface (not shown) and in which cover unit 12 is in the open position shown in FIGS. 2 and 3. As described above, an axle 145 extends through housing 15 and housing 11 and supports a pair of paddle wheels 120 and 130. Paddle wheel 120 includes four perpendicularly spaced paddles 122, 123, 124 and 125. Similarly, paddle wheel 130 includes four perpendicularly spaced paddles 132, 133, 134 and 135. It should be noted that in accordance with an important aspect of the present invention, paddle wheels 120 and 130 are angularly offset with respect to each other by forty-five degree angle indicated by angle 152 between paddle 124 of paddle wheel 120 and paddle 134 of paddle wheel 130.

A ratchet drive 111 is coupled to side 20 of cover unit 12 and supported by housing 15. Ratchet 111 is further coupled to a pulley 110. A second pulley 113 is coupled to axle 145 and a flexible belt 112 is stretched between pulleys 110 and 113. Ratchet drive 111 is constructed in accordance with conventional one-way ratcheting structures and includes a ratchet bar 114 supported against housing 15 by a pivot 115. Ratchet bar 114 and ratchet 111 cooperate to inhibit rotation of pulley 110 when cover unit 12 is pivoted in the closing direction indicated by arrow 148. Conversely, ratchet drive 111 and ratchet bar 114 cooperate to permit pulley 110 to rotate when cover unit 12 is opened and pivots in the direction indicated by arrow 149. In accordance with an important aspect of the present invention, the relative sizes of pulleys 110 and 113 are selected to ensure that pulley 113 is rotated through one-half the angular rotation of pulley 110. In operation, with cover unit 112 in the closed position shown in FIG. 1, the opening motion in the direction indicated by arrow 149 causes rotation of pulley 110 in the direction indicated by arrow 153 and a corresponding rotation of pulley 113 in the direction indicated by arrow 155. Because cover unit 12 undergoes a ninety degree angular movement in the opening motion, pulley 110 undergoes a corresponding ninety degree angular rotation which in turn causes a forty-five degree angular motion of pulley 113. Conversely, when cover unit 12 is returned from the open position shown in FIGS. 2 and 3 to the closed position of FIG. 1, it is pivoted in the direction indicated by arrow 148 which, but for the one-way operation of ratchet drive 111, would cause pulley 110 to rotate in the dlockwise direction indicated by arrow 154. However, in accordance with the operation of ratchet 111, pulley 110 remains fixed as cover unit 12 is pivoted in the direction indicated by arrow 148 to return to the closed position.

Figure 5A:
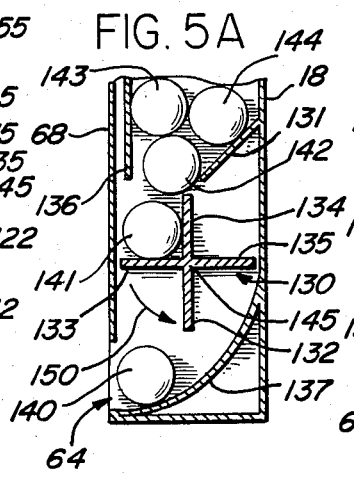
FIGS. 5A and 5B are sequential section views of the dispensing apparatus of the present invention coin operated infant changing table.
Figure 5B:
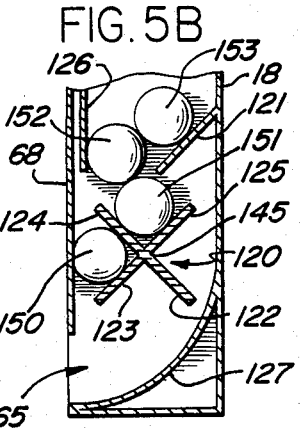

FIGS. 5A and 5B set forth simplified section views of paddle wheels 130 and 120 respectively. In FIG. 5A, housing 11 defines a dispenser cover 68 and a rear surface 18. Dispenser cover 68 further supports a vertical guide 136 while rear surface 18 supports an angular guide 131. Guide 136 and 131 cooperate to provide a restricted path for convenience products 142, 143 and 144 in the downward direction. Paddle wheel 130 is, as described above, rotatably supported within housing 11 and includes a quartet of paddle wheels 132 through 135. Housing 11 further defines a curved guide 137 and a slot 64. In the position shown in FIG. 5A, paddle wheel 130 has completed an angular rotation in the direction indicated by arrow 150 in the above-described dispensing action resulting in the release of a convenience product 140 from confinement between paddles 132 and 133 and dispenser cover 68. As a result, convenience product 140 falls downwardly from between paddles 133 and 132 and outwardly through slot 64. In the position shown in FIG. 5A, the rotation of paddle wheel 130 resulting in dispensing of convenience product 140 simultaneously permits the transfer of convenience product 141 from the accumulated supply above guides 131 and 136 to the position shown between paddles 133 and 134.

Similarly, FIG. 5B shows the simultaneous position of paddle wheel 120 within housing 11 corresponding to the position of paddle wheel 130 shown in FIG. 5A. In similarity to the structure of FIG. 5A, dispenser cover 60 extends downwardly covering housing 11 which in turn supports vertical guide 126 and angled guide 121 to support a plurality of convenience products 152 and 153. Housing 15 defines a curved guide 127 similar to guide 137 in FIG. 5A. Because of the foregoing described angular offset between paddle wheels 120 and 130, paddle wheel 120 which includes four equally spaced paddles 122 through 125 is offset by forty-five degrees from paddle 130 and thus continues to captivate a convenience product 150 between paddles 123 and 124 and dispenser cover 68.

With simultaneous reference to FIGS. 5A and 5B, it should be noted that during the next opening motion of cover unit 12 (see FIG. 4) a forty-five degree rotation of paddle wheels 120 and 130 will take place in the directions indicated by arrow 151 and 150 respectively. During that forty-five degree rotation, convenience product 150 will be released from confinement between paddles 123 and 124 and dispensed through slot 65. Correspondingly, during the same forty-five degree angular movement of paddle 130, convenience product 141 will be captivated between paddle wheels 133 and 134 and dispenser cover 68.

As a result, each time cover unit 12 is opened and pivoted downwardly from housing 11, a corresponding rotation of forty-five degrees occurs in paddle wheels 120 and 130 resulting in alternate dispensing of convenience product through slots 64 and 65. While any number of convenience products may be dispensed in accordance with the foregoing described operation of the present invention infant changing table, it has been found particularly convenient to use convenience products which comprise rolled absorbent pads for use in the infant changing activity. It will be apparent, however, that any number of products may be used, such as packaged diaper wipes.

What has been shown is a convenient, economical and simple to use coin operated infant changing table which folds to an extremely compact configuration when not in use and which readily extends to a secure reliable extended position and facilitates the care of infants in public places and during travel. The coin operated infant changing table shown provides for convenient availability of a sanitary fresh working surface for receiving the infant as well as the extension of safety support arms adjacent the working surface to protect against accidental falls by the infant. In addition, the present invention coin operated infant changing table automatically dispenses a convenience product during the opening motion of the cover unit.

While particular embodiments of the invention have been shown and described, it will be obvious to those skilled in the art that changes and modifications may be made without departing from the invention in its broader aspects. Therefore the aim in the appended claims is to cover all such changes and modifications as fall within the true spirit and scope of the invention.

That which is claimed is:

1. A coin operated infant changing table comprising:

a wall housing attachable to a vertical surface, said wall housing including a dispensing means for storing and dispensing convenience products;

a cover unit, defining a table surface, pivotally secured to said wall housing and rotatable between a closed position against said wall housing and an extended position in which said cover unit extends outwardly from said wall housing to support said table surface horizontally;

a pair of hinged support members coupled between said wall housing and said cover unit and forming protective side members adjacent said table surface in said extended position;

coin means for locking said cover unit to said wall housing in said closed position and releasing said cover unit when a predetermined combination of coins are received within said coin means; and operating means coupled to said cover unit and said dispensing means, said operating means dispensing a convenience product each time said cover unit is rotated from said closed position to its extended position.

2. A coin operated infant changing table as set forth in claim 1 wherein said table surface includes a resilient pad.

3. A coin operated infant changing table as set forth in claim 2 wherein said wall housing includes a paper roll, having a paper sheet rolled thereon, supported adjacent to said table surface for permitting a portion of said paper sheet to be drawn across said resilient pad.

4. A coin operated infant care table as set forth in claim 3 wherein said dispensing means include:

a vertical receptacle defining a vertical channel and exit slot for receiving a plurality of convenience products in a stacked array;

a paddle wheel having a plurality of angularly disposed paddles horizontally disposed within said vertical receptacle adjacent said exit slot supporting said convenience products and serially dispensing said convenience products through said exit slot when said paddle wheel is rotated.

5. A coin operated infant changing table as set forth in claim 4 wherein said operating means include:

ratchet means coupled to said cover unit and supporting a first pulley;

a second pulley coupled to said paddle wheel; and a drive belt coupled between said first and second pulleys;

said ratchet means rotating said first pulley solely during pivotal motion of said cover unit from said closed position to said extended position causing a corresponding incremental rotation of said paddle wheel to carry a unit of said convenience product from said vertical channel to said exit slot.

6. A coin operated infant changing table comprising:

a vertical wall housing having top, bottom, side and rear surfaces forming an interior cavity;

a pair of product dispensing channels supported within said interior cavity;

a generally planar dispenser cover secured to said side and top surfaces to enclose a portion of said product dispensing channels and defining a pair of exit slots beneath said channels;

a cover unit having a planar table surface and a pair of parallel side members, pivotally secured to said side surfaces of said vertical wall housing and pivotable between a closed position overlying said dispenser cover and an extended position extending perpendicularly from said vertical wall housing;

coin receiving means for receiving a predetermined combination of coins;

lock means coupled to and operated by said coin receiving means for releasably securing said cover unit to said wall housing in said closed position;

a pair of paddle wheels having a common axle rotatably supported within each of said product dispensing channels;

a ratchet drive coupled to said cover unit having a first pulley, said ratchet drive being operative to rotate said first pulley solely in response to movement of said cover unit from said closed position to said extended position;

a second pulley coupled to said axle;

a pulley belt coupling said first and second pulleys; and a pair of foldable arm members extending between said side surfaces of said vertical wall housing and said side members of said cover unit.

7. A coin operated infant changing table as set forth in claim 6 wherein said cover unit includes a resilient changing pad supported upon said table surface.

8. A coin operated infant changing table as set forth in claim 7 having a roll of paper, having an elongated sheet of paper rolled thereon, supported within said wall housing beneath said exit slots, said paper sheet being drawn from said paper roll to cover said changing pad.

9. A coin operated infant changing table as set forth in claim 8 wherein said pair of paddle wheels are angularly offset.

10. A coin operated infant changing table as set forth in claim 9 wherein said cover unit includes a tear bar extending between said side member adjacent said changing pad.

* * * * *